United States Patent [19]

Schmidt

[11] Patent Number: 4,874,113

[45] Date of Patent: Oct. 17, 1989

[54] DISPENSERS FOR COSMETICS

[76] Inventor: Laurie H. Schmidt, P.O. Box 541237, Dallas, Tex. 75354-1237

[21] Appl. No.: 158,798

[22] Filed: Feb. 22, 1988

[51] Int. Cl.[4] ..... B67D 5/60

[52] U.S. Cl. ..... 222/143; 222/181

[58] Field of Search ..... 222/129, 132, 135, 143, 222/180–181, 185, 192, 252, 255, 207, 383, 520

[56] References Cited

U.S. PATENT DOCUMENTS

| | | | |
|---|---|---|---|
| 1,875,992 | 9/1932 | Clifford | 222/530 X |
| 2,275,703 | 3/1942 | Trester et al. | 222/181 |
| 2,950,030 | 8/1960 | McConnohie | 222/207 X |
| 3,137,417 | 6/1964 | Zetterstrom | 222/530 X |
| 3,194,426 | 7/1965 | Brown, Jr. | 222/143 X |
| 3,752,365 | 8/1973 | Coleman | 222/181 |
| 3,955,715 | 5/1976 | Topor | 222/143 |
| 3,990,611 | 11/1976 | Sojka | 222/135 |
| 4,530,448 | 7/1985 | Ponyicky | 222/181 |
| 4,741,461 | 5/1988 | Williamson el al. | 222/181 |

FOREIGN PATENT DOCUMENTS

| | | | |
|---|---|---|---|
| 2164633 | 3/1986 | United Kingdom | 222/181 |

*Primary Examiner*—Michael S. Huppert

*Attorney, Agent, or Firm*—John M. Cone

[57] ABSTRACT

A dispenser for cosmetics has vertically extending alignment means on its side walls whereby similar dispensers can be readily assembled into a modular arrray by vertical relative motion between two dispensers. A mounting plate securely fastened to a wall surface cooperates with mounting lugs on the rear of the dispenser for securely mounting the dispenser on the wall.

8 Claims, 2 Drawing Sheets

DISPENSERS FOR COSMETICS

FIELD OF THE INVENTION

The present invention relates to dispensers for cosmetics, such as skin and hair care products, e.g. shampoo, soap and moisturizing cream and dry goods, such as cotton balls and swabs. In particular, this invention relates to dispensers which, while each is complete in itself, can readily be assembled into a modular array of dispensers.

PRIOR ART

One form of modular container is shown in U.S. Pat. No. 3,955,715 (Topor). In Topor, identical containers are assembled in side by side relationship and are secured together by horizontally extending interlocking means, which extend from the front to the rear of each container. The interlocking means comprise complimentary undercut projections and channels formed on opposite sides of each container. In use, each container in Topor is secured to a wall by means of pressure sensitive adhesive strips mounted on the rear of that container.

The container shown in Topor is secured to the wall only by its adhesive strips which provide insufficient security against unauthorized removal. In addition, removal of the containers for refilling or cleaning involves detaching the adhesive strips from the wall. While the strips may remain effective after one or two removals and replacing, repeated removal causes damage to the strip, rendering it ineffective.

THE PRESENT INVENTION

According to the present invention there is provided a dispenser for cosmetics adapted to constitute a unit of a modular array of essentially similar dispensers and comprising a body of substantially rectangular horizontal cross-section, having front, rear and side walls, a bottom and a top wall; the side walls of said container having respective male and female alignment means of complementary shape, whereby two such dispensers can be combined in an aligned, side by side, array with the male alignment means of one dispenser engaged with the female alignment means of the other; said male and female alignment means extending substantially vertically over at least the major part of the wall surface whereby the two dispensers can be aligned by vertical relative motion between them; mounting means for the dispenser, adapted to be secured to a vertical surface, such as a wall, and having an upwardly open channel extending from the upper edge of said plate and closed at its lower end, said channel receiving, in use, a flanged member provided on the rear wall of the dispenser and having spaced apart side portions engaging the edges of the channel.

Preferably the male and female alignment means comprise respectively a vertically extending rib having undercut side edges and a vertically extending open-ended channel having undercut side edges complementary to the edges of the male alignment means.

Advantageously, the plate has upstanding side edges which, in use, seal against the sides of the rear wall of the dispenser. In this form of the invention, the plate has a central section displaced from the plane of the plate in the same direction as the upstanding side edges, the slot being provided in the displaced section and extending from an upper edge of the plate.

THE DRAWINGS

The invention will now be described, by way of example only, with reference to the accompanying drawings which:

DETAILED DESCRIPTION

Figure 1:
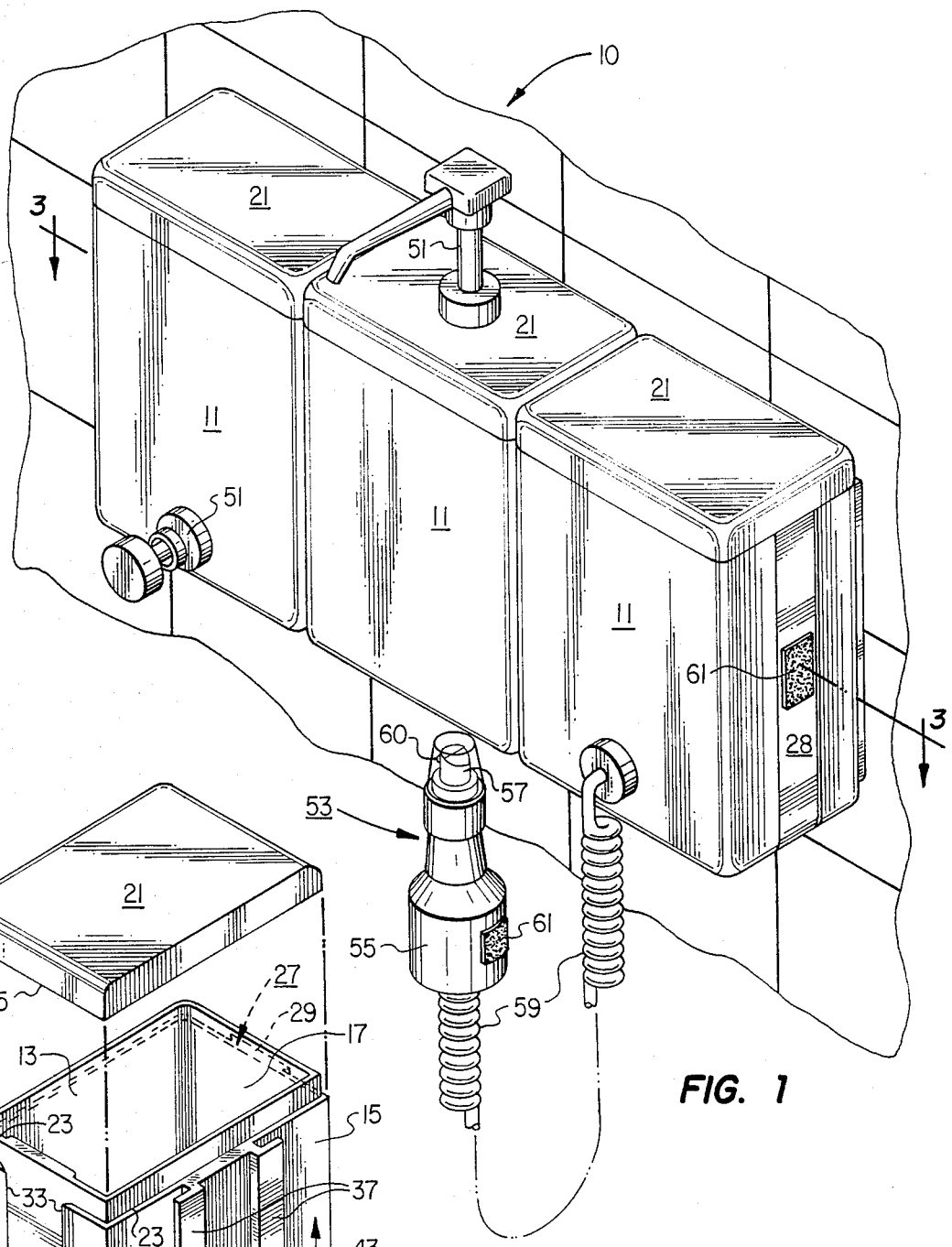
FIG. 1 is a front perspective view of an array of three dispensers embodying the present invention.
Figure 2:
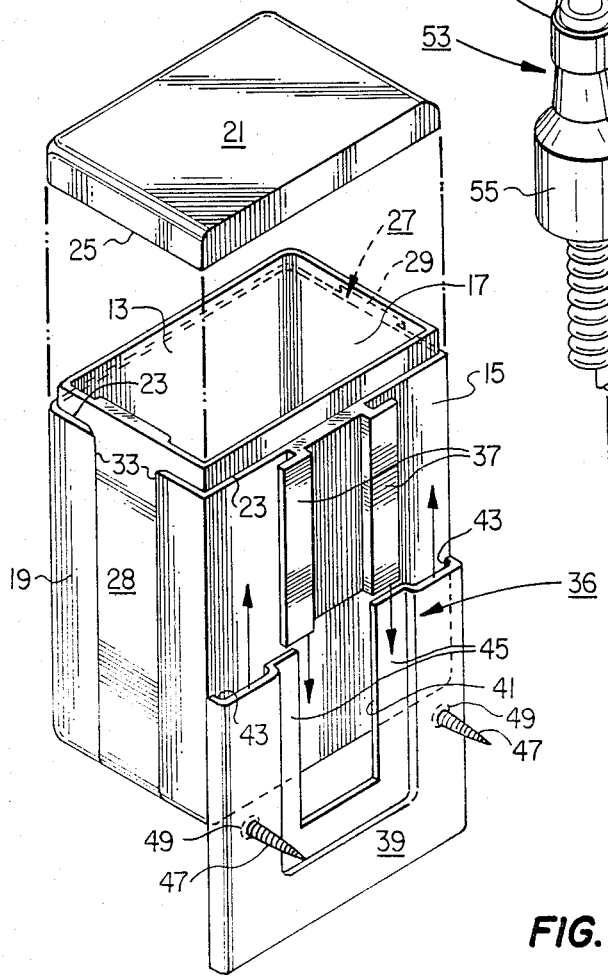
FIG. 2 is a rear perspective view of one of the dispensers shown in FIG. 1.

FIG. 1 shows a modular array 10 of three substantially identical dispensers 11 each embodying the invention. As best seen in FIG. 2, each dispenser 11 comprises a molded plastic body of rectangular cross-section comprising a bottom wall (not seen in FIG. 2), front and rear walls 13 and 15 and side walls 17 and 19. The dispenser 11 is normally closed by a removable cover 21. Each of the walls 13, 15, 17 and 19 is rebated near its upper end forming a shoulder 23. The cover 21 is adapted to fit down over the upper edge of the walls 13, 15, 17 and 19, with a lower edge 25 of the cover 21 resting on the shoulder 23.

Figure 3:
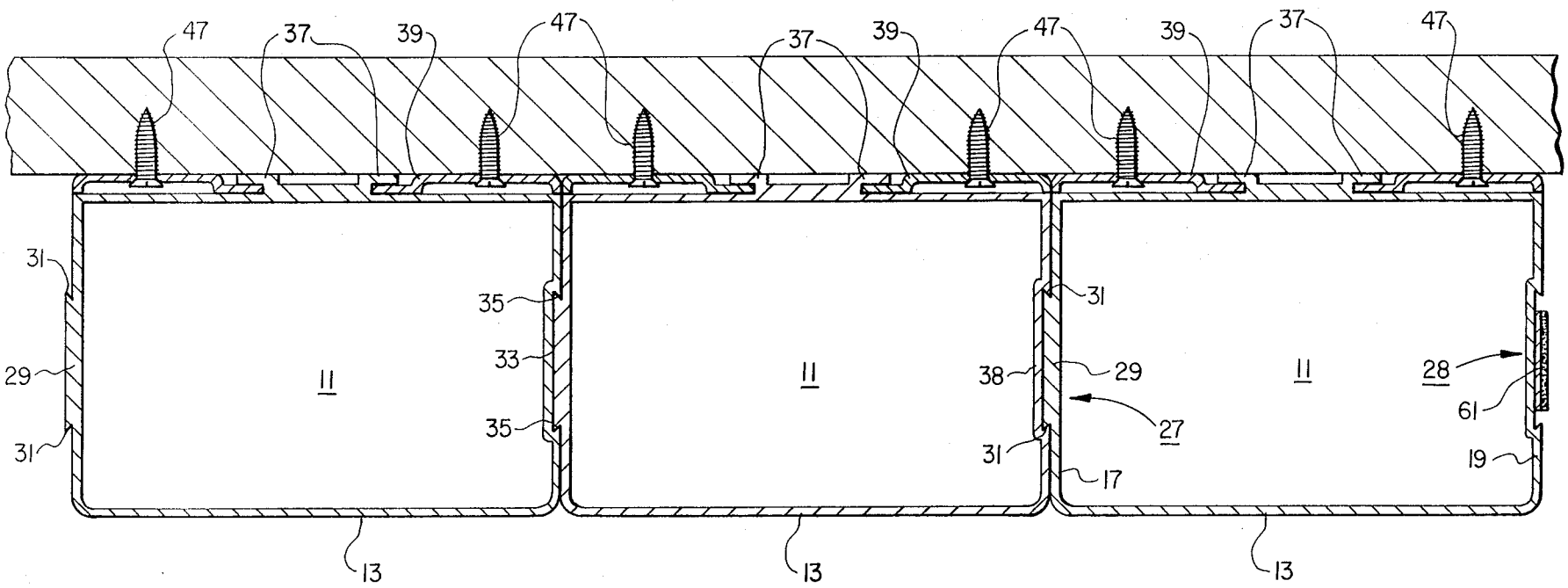
FIG. 3 is a horizontal cross-section on the line 3—3 in FIG. 1.

Each dispenser 11 is formed on its side walls 17 and 19 respectively with complementary male 27 and female 28, vertically extending alignment means, see FIG. 3. Each male alignment means 27 comprises a rib 29 upstanding from and central positioned on the side wall 17 and extending vertically substantially the entire length of the side wall 17. The rib 29 has undercut longitudinal edges 31. Each female alignment means 28 comprises a channel 33 of shape complementary to that of the rib 29. Each channel has undercut longitudinal side edges 35, see FIG. 3. The male and female alignment means 27 and 28 of two dispensers can be interengaged by aligning the upper end of the alignment means of one dispenser with the lower end of the complementary alignment means of other dispenser and sliding the two dispensers vertically with respect to one another.

Means 36 are provided for mounting each dispenser on a vertical surface, such as a wall. The mounting means 36 comprises a pair of aligned, parallel L-shaped sections 37, each of which extends about one half way down the rear wall 15, and a receiving plate 39 secured, in use, to the vertical surface. The sections 37 are symmetrically located one on each side of the vertical center line of the rear wall 15 and each section is arranged with the upright limb of the L secured at its upper end to the rear wall 15 and the lower limb of the L extending outwardly and parallel to the rear wall 15. The dispenser 11 comprising the side, rear and bottom walls and the two L-shaped sections 37 are preferably molded as a unit from opaque plastic material.

The plate 39 is formed with a rectangular, vertically extending slot 41 open at its upper end to receive the L-shaped sections 37. The plate 39 is substantially the same size as the rear wall 15. The slot 41 is centrally located and extends less than the full length of the plate 39.

As best seen in FIG. 3, the plate 39 in horizontal cross-section has marginal lips 43 on its side edges, and rebated inner edges 45, which define the slot 41. This construction enables a close fit between the dispenser 11 and the vertical surface to be achieved with the lips 43 engaged against the rear wall 15 of the dispenser 11 at its outer edges. In use, the plate is secured to the wall by screws 47 extending through holes 49 in the plate 39. In addition, double-sided adhesive tape (not shown) is used to secure the plate 39 to the wall.

The contents of the dispenser 11 can be dispensed using a manually operable pump 51, the construction of which is well known in the art and does not form part of this invention. The pump 51 can be arranged to extend through the cover 21, or alternatively through the front wall at the lower end thereof. Alternatively, as best seen in FIG. 1, the dispenser may be provided with a spray device 53 comprising a one or two ounce compressible spray bottle 55 connected to the interior of the dispenser 11 by a hollow, flexible tube 59. The bottle 55 has a spray nozzle and pump 57, normally covered by a removable cap 60. The construction of the nozzle and pump 57 is well known in the art to which this invention relates and does not form part of this invention.

The bottle 55 is releasably attached to the side of the dispenser by means of a fastener 61 formed from two strips of synthetic material which adhere when pressed together, one piece being secured to the side of the dispenser 11 and the other to the side of the spray bottle 55. Alternatively the bottle 55 may be mounted on a u-shaped, plastic, holder (not shown) fixed to the side wall of the dispenser 11.

It will be appreciated that the dispenser 11 could be used to store dry goods, such as cotton balls. These would be retrieved by removing the lid 21 of the container. In that case, the pump 51 could be omitted.

Although the dispenser has been described and illustrated as mounted on a vertical surface, it will be readily apparent that the dispenser could be mounted on a horizontal surface, such as the underside of a shelf, or closet, using the mounting means 36 described above.

I claim:

1. A dispenser for cosmetics adapted to constitute a unit of a modular array of essentially similar dispensers and comprising a body of substantially rectangular horizontal cross-section, having front, rear and side walls, a bottom and a top wall; the side walls of said dispenser having respective male and female alignment means of complementary shape, whereby two such dispensers can be aligned in an aligned, side by side, array with the male alignment means of one dispenser engaged with the female alignment means of the other; said male and female alignment means extending substantially vertically over at least the major part of the wall surface whereby the two dispensers can be aligned by vertical relative motion between them; mounting means for the dispenser, said mounting means comprising a plate, separate from the dispenser, adapted to be secured to a vertical surface, such as a wall, the plate being of substantially the same width as the rear wall of the body, whereby when two dispensers are arranged in said array, the outer vertical edges of their respective plates are in contact, said plate having an upwardly open channel extending from the upper edge of said plate and closed at its lower end, said channel receiving, in use, a flanged member provided on the rear wall of the dispenser and having spaced apart side portions engaging the edges of the channel.

2. A dispenser according to claim 1 wherein the said male and female alignment means comprise respectively a vertically extending rib having undercut side edges and a vertically extending opened channel having undercut side edges complementary to the edges of the male alignment means.

3. A dispenser according to claim 1 wherein the container, alignment means and the flanged member are a one-piece molded unit.

4. A dispenser according to claim 1 wherein the said plate has upstanding side edges which, in use, seal against the sides of the rear wall of the dispenser.

5. A dispenser according to claim 4 wherein the plate has a central section displaced from the plane of the plate in the same direction as the upstanding side edges, a slot being provided in the displaced section and extending from an upper edge of the plate.

6. A dispenser according to claim 5 wherein the flanged member comprises two, spaced apart, essentially L-shaped, vertically extending members each having the upright limb of the L adjacent the rear wall of the dispenser and the lower limb of the L extending outwardly in the direction away from the center line of the rear wall.

7. A dispenser according to claim 1 including manually operated pump means for dispensing material from the interior of the dispenser.

8. A dispenser according to claim 7 wherein the pump means comprises a compressible bottle connected via a flexible tube to the interior of the dispenser, and means for detachably mounting the bottle on the exterior of the dispenser.

* * * * *